United States Patent [19]

Höglund et al.

[11] 4,280,868

[45] Jul. 28, 1981

[54] METHOD FOR REFINING LIGNOCELLULOSE-CONTAINING MATERIAL

[75] Inventors: Hans E. Höglund, Matfors; Per V. Peterson, Sundsvall, both of Sweden

[73] Assignee: Sunds Defibrator Aktiebolag, Sweden

[21] Appl. No.: 69,082

[22] Filed: Aug. 23, 1979

[30] Foreign Application Priority Data

Aug. 29, 1978 [SE] Sweden ..... 7809085

[51] Int. Cl.[3] ..... D21D 1/30

[52] U.S. Cl. ..... 162/28; 241/28; 241/261.2

[58] Field of Search ..... 241/16, 28, 60, 245, 241/261.2, 261.3; 162/20, 23, 24, 28, 26

[56] References Cited

U.S. PATENT DOCUMENTS

| | | | |
|---|---|---|---|
| 2,008,892 | 7/1935 | Asplund | 162/23 |
| 3,076,610 | 2/1963 | Rosenfeld et al. | 241/28 |
| 3,138,336 | 6/1964 | Lejeune et al. | 241/73 |
| 3,448,934 | 6/1969 | Vaughan | 241/146 |
| 3,467,754 | 9/1969 | West | 162/24 |
| 3,617,006 | 4/1970 | Jones | 241/28 |
| 3,847,363 | 11/1974 | Reinhall | 241/245 |

FOREIGN PATENT DOCUMENTS

| | | |
|---|---|---|
| 343444 | 3/1978 | Austria . |
| 213691 | 6/1967 | Sweden . |
| 304322 | 6/1971 | U.S.S.R. . |
| 316802 | 7/1971 | U.S.S.R. . |

*Primary Examiner*—S. Leon Bashore
*Assistant Examiner*—Steve Alvo
*Attorney, Agent, or Firm*—Lerner, David, Littenberg & Samuel

[57] ABSTRACT

A method and apparatus for use in making refiner pulp by refining lignocellulose-containing materials in a disc refiner. In accordance with the method and apparatus, the retention time of the material in a gap between a pair of refining discs is increased by diluting the refined material exiting from the gap so as to form a fiber suspension having an easily pumpable concentration and maintaining a predetermined amount of the fiber suspension adjacent to the outlet of the gap.

11 Claims, 4 Drawing Figures

METHOD FOR REFINING LIGNOCELLULOSE-CONTAINING MATERIAL

FIELD OF THE INVENTION

A method and apparatus for use in the manufacture of refiner pulps having a high yield, i.e., greater than about 85 percent, by refining lignocellulose-containing material, such as chips, sawdust or defibred chips. The material is preheated and/or treated with lignin-softening chemicals prior to being refined.

BACKGROUND OF THE INVENTION

Swedish Patent Application No. 7801877-7 discloses that pulps of high quality can be manufactured at lower energy consumptions than had been possible previously by using a material having a fiber concentration lower than the usual conventional concentration. When the fiber concentration between a pair of refining discs is lowered to levels below about 15 percent, the fiber material can be refined to obtain a desired pulp quality without consuming the amount of energy normally required for refining material having higher fiber concentrations.

It is difficult, however, to utilize material having fiber concentrations lower than about 15 percent in a conventional refiner, due to the difficulty in obtaining a sufficient retention time of such material and, hence, treatment of the fiber material between the discs. At low fiber concentrations, the fiber network offers too little resistance to the centrifugal force which urges the material towards the periphery of the discs. By moving the discs closer to each other and thereby reducing the gap therebetween, it is possible to increase the resistance of the fiber material to movement so as to increase the retention time of the fiber material in the gap. However, at these low fiber concentrations, the gap must be reduced to such a small size that the possibility of fiber damage increases substantially.

As disclosed in the Swedish Patent Application No. 7801877-7, a controlled amount of water, preferably waste-water from the mill, is continuously supplied to a refiner housing surrounding the refining discs, so that the housing is filled with a fiber suspension of easily pumpable concentration, preferably 1–6 percent. The fiber suspension in the housing forms a barrier adjacent to the discharge opening of the gap, thereby making it difficult for the fiber material to pass out of the gap, i.e., the fiber material is braked and transported more slowly through the gap.

The rotation of one or both of the refining discs in a housing filled with a fiber suspension is disadvantageous because it causes energy to be consumed as the result of (i) the friction between the rotating refining disc or discs and the fiber suspension and (ii) the turbulence in the suspension. This no-load energy is lost energy and of no benefit at all to the refining operation. Therefore, it should be reduced to a minimum in order to save energy.

SUMMARY OF THE INVENTION

The present invention overcomes many of the disadvantages and shortcomings described above by substantially reducing the contact surface between a pair of refining discs and a fiber suspension maintained externally of the discs. In one especially advantageous embodiment of the invention, a chamber is provided adjacent the outlet of a gap formed between a pair of refining discs. The chamber, which extends circumferentially about the discs, is filled with a fiber suspension. A predetermined amount of water is supplied to the chamber to give the fiber suspension a predetermined concentration.

By adjusting this concentration and the size of a passageway, through which the suspension is urged out into a housing surrounding the chamber, the pressure at which the suspension in the chamber is maintained can be adjusted to regulate the breaking effect that the fiber suspension has on the flow of the fiber material through the gap and, hence, the retention time of the fiber material in the gap. Thus, in accordance with the present invention, it is possible to carry out the refining of lignocellulose-containing material at optimum low concentrations in the gap, without (i) significantly decreasing the retention time of the material in the gap and (ii) causing unnecessary no-load losses due to friction and turbulence in the housing.

BRIEF DESCRIPTION OF THE DRAWINGS

For a more complete understanding of the present invention, reference may be had to the following description of three exemplary embodiments taken in conjunction with the accompanying figures of the drawings, in which.

DESCRIPTION OF THE EXEMPLARY EMBODIMENTS

With reference to FIGS. 1–4, the refiner illustrated therein is a disc refiner of the type disclosed in Swedish Patent Application No. 780187-7. Thus, the refiner can have one stationary refining disc and one rotary refining disc or, alternatively, a pair of counter-rotating refining discs.

Figure 2:
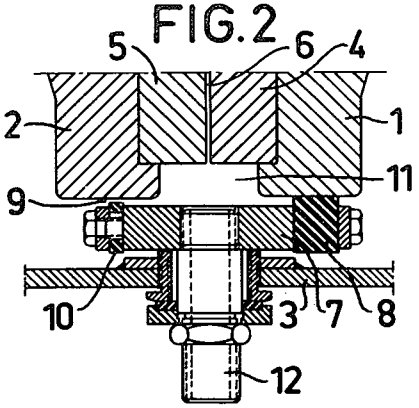
FIG. 2 is a cross-sectional view, taken along line A—A in FIG. 1 and looking in the direction of the arrows, illustrating one embodiment of the present invention.
Figure 3:
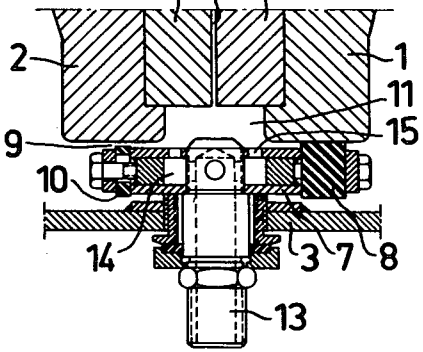
FIG. 3 is a cross-sectional view, taken along line A—A in FIG. 1 and looking in the direction of the arrows, of a second embodiment of the invention.
Figure 1:
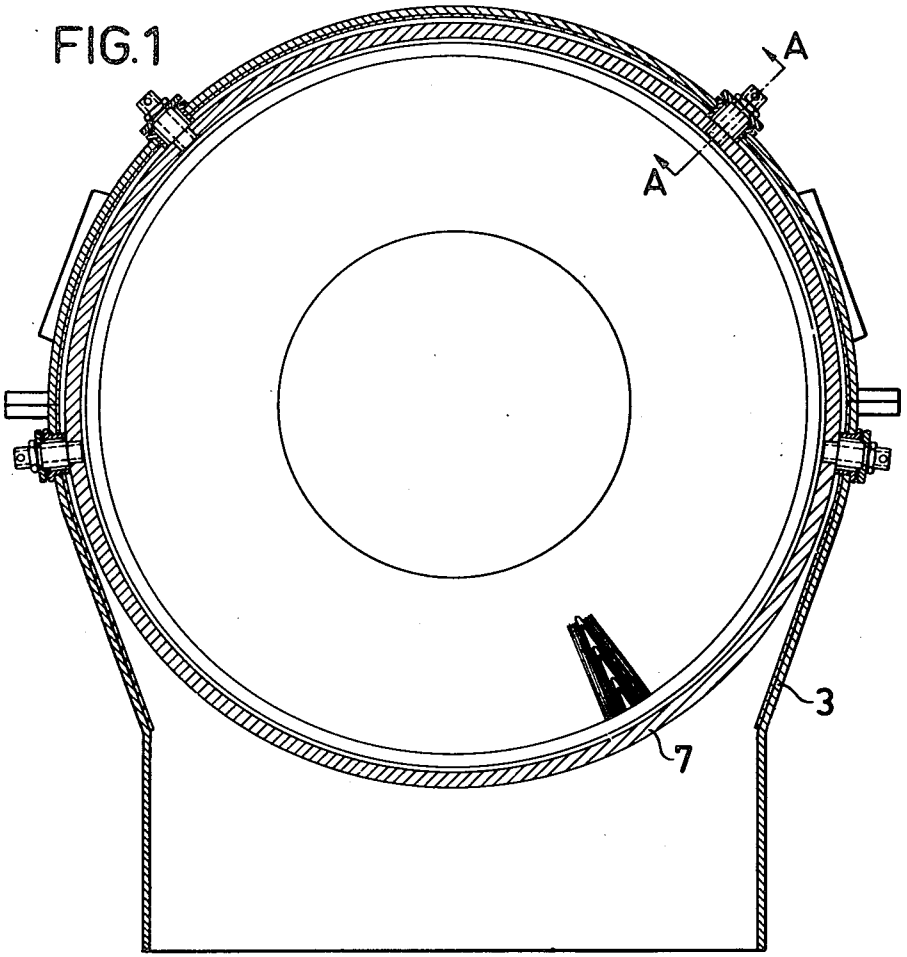
FIG. 1 is a radial cross-sectional view taken through a gap between a pair of refining discs of a disc refiner constructed in accordance with the present invention.

Referring to FIGS. 1–3, there are shown refining discs 1, 2 which rotate in opposite directions. The refining discs 1, 2, which are surrounded by a refining housing 3, constitute holders for refining segments 4, 5, between which a gap 6 is formed. The size of the gap 6 can be adjusted by axially displacing one of the refining discs 1, 2 with respect to the other of the refining discs, 1, 2.

The refining housing 3 contains a stationary annular wall element 7 which surrounds the gap 6 in close proximity to the refining discs 1, 2. The wall element 7 has a sealing member 8 which contacts the periphery of the refining disc 1. A passageway 9 is maintained between the wall segment 7 and the periphery of the refining disc 2. The size of the passageway 9 is determined by an annular throttling ring 10, which extends radially inwardly from the wall element 7 toward the refining disc 2. The distance that the throttling ring 10 extends radially inwardly beyond the wall element 7 can be varied to adjust the size of the passageway 9. The annular wall member 7, including the sealing member 8 and the throttling ring 10, together with the refining discs 1, 2 and the refining segments 4, 5 delimit an annular chamber 11 which communicates directly with the gap 6 and indirectly, i.e., through the passageway 9, with the interior of the refining housing 3.

As shown in FIG. 2, a plurality of inlet pipes 12 are provided to supply a controlled amount of diluting water to the chamber 11. Each of the inlet pipes 12 extends transversely through the wall element 7 and communicates directly with the chamber 11.

With particular reference to FIG. 3, there is shown a plurality of inlet pipes 13, each of which communicates with an annular cavity 14 formed in the wall element 7. The cavity 14 is provided with a plurality of openings 15, each of which extends radially inwardly and communicates with the chamber 11. The openings 15 are uniformly distributed circumferentially along the inner circumferential edge of the wall element 7.

Figure 4:
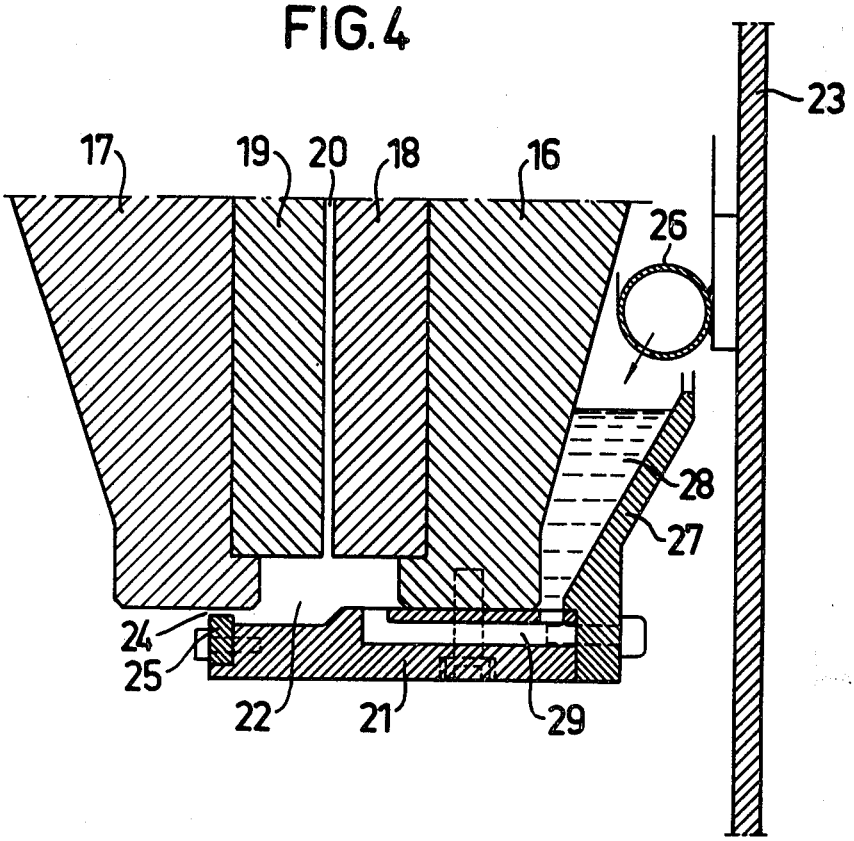
FIG. 4 is a cross-sectional view, which is similar to the cross-sectional views of FIGS. 2 and 3, illustrating a third embodiment of the present invention.

The refiner of the embodiment illustrated in FIG. 4 includes two counter-rotating refining discs 16, 17, which are provided with refining segments 18, 19, respectively. A gap 20 is formed between the refining segments 18, 19. An annular wall element 21 extends circumferentially about the gap in close proximity to the refining discs 16, 17. The wall element 21 is attached to the refining disc 16 and, together with the refining discs 16, 17 and the refining segments 18, 19, defines an annular chamber 22 adjacent to the outlet of the gap 20. The chamber 22 communicates with a surrounding refining housing 23 through a passageway 24, which is delimited by the periphery of the refining disc 17 and an annular throttling ring 25 extending radially inwardly from the wall element 21.

Diluting liqiud is supplied to the outer surface of the refining disc 16 from a spray pipe 26 provided in the refining housing 23. The liquid is thrown radially outwardly by the centrifugal force from the rotation of the refining disc 16 and is caught by a shield 27, which extends alongside the refining disc 16 near the periphery thereof. The shield 27 and the adjacent side of the refining disc 16 form a channel 28 which communicates with the chamber 22 through holes 29 in the wall element 21. The radially inner end of the channel is open so as to receive liquid from the spray pipe 26.

Prior to refining, the lignocellulose-containing material is preheated with steam and/or treated with lignin-softening chemicals, for example, $Na_2SO_3$ in a known conventional manner. The material thereafter is fed into the refiner and then between the refining discs 1, 2. The pressure of the material in the feed zone, i.e., the location where the material is fed through at least one of the discs 1, 2 just prior to entering the gap therebetween, is usually in a range of from about 10 kPa to about 260 kPa, and preferably in the range of from about 20 kPa to about 140 kPa, which correspond to a temperature range of about 100° C. to about 140° C. and a range of from about 105° C. to about 125° C., respectively. The material may be diluted when it is in the feed zone prior to refining.

By continuously supplying a controlled amount of diluting water, preferably waste-water from the mill, to the chamber 11 in FIGS. 2 and 3 or the chamber 22 in FIG. 4, the pulp (refined material) is diluted after refining, i.e., after exiting from the gap between the refining discs, to an easily pumpable concentration in a range of from about 1 percent to about 6 percent and preferably in a range of from about 2 percent to about 5 percent, so that the chamber 11 in FIGS. 2 and 3 and the chamber 22 in FIG. 4 can be filled with a fiber suspension having a predetermined concentration. The fiber suspension in the chamber 11 of FIGS. 2 and 3 or the chamber 22 in FIG. 4 forms a barrier about the outlet of the gap 6 (see FIGS. 2 and 3) or the gap 20 (see FIG. 4) to break the acceleration of the fiber material therethrough, thereby increasing the retention time of the material in the gap 6 of FIGS. 2 and 3 or the gap 20 of FIG. 4.

In the chamber 11 of FIGS. 2 and 3 or the chamber 22 of FIG. 4, the fiber suspension is maintained at a pressure which substantially corresponds to the pressure of the material in the feed zone. It is possible, however, to maintain the fiber suspension in the chamber 11 of FIGS. 2 and 3 or the chamber 22 of FIG. 4 at a higher pressure than the pressure of the material in the feed zone. The retention time of the material in the gap 11 of FIGS. 2 and 3 or in the gap 22 of FIG. 4 can thereby be further increased. The pressure of the fiber suspension in the chamber 11 of FIGS. 2 and 3 or the chamber 22 of FIG. 4 is controlled by the throttling ring 10 of FIGS. 2 and 3 or the throttling ring 25 of FIG. 4 and by the amount of diluting water supplied through the feed pipes 12 (see FIG. 2), 13 (see FIG. 3) and 26 (see FIG. 4). The refining housing 3 of FIGS. 2 and 3 or the refining housing 23 of FIG. 4 may be open or closed, in order to maintain a certain excess pressure therein.

By refining material having a relatively low concentration, i.e., in the range of from about 6 percent to about 15 percent as it exits from the outlet of the gap, i.e., before it is diluted to form the fiber suspension, much less steam is produced than when refining material having higher concentrations. Thus, no or very little steam flows upstream against the incoming chips. Also, the steam flowing out through the gap 11 of FIGS. 2 and 3 or the gap 22 of FIG. 4 has a low velocity and condenses almost instantaneously in the fiber suspension surrounding the refining discs 1, 2 of FIGS. 2 and 3 or the refining discs 16, 17 of FIG. 4. The low concentration also permits a more uniform distribution of material in the gap 11 of FIGS. 2 and 3 or the gap 22 of FIG. 4.

The material to be refined as described above can be defibered chips, i.e., a fiber material which has been partially defibered with relatively low energy consumption during a prior refining operation. Prior to their defibration, the chips may be preheated and/or treated with lignin-softening chemicals. Inasmuch as the gap used in such a defibration process is relatively large, fiber damage is insigificant.

Refining of fiber material at low concentrations, preferably in the range of about 2 percent to about 5 percent, has been done in the past. The fiber material, however, was of the low-yield type, usually about 50 percent, i.e., so-called chemical pulps, or of yields up to about 80 percent, i.e., so-called semi-chemical pulps. Both of these low-yield types of fiber material have a character entirely different from the character of the fiber material which can be used in conjunction with the present invention, i.e., fiber materials having a yield greater than about 85 percent.

The low-yield types of fiber material, i.e., those having a yield less than about 80 percent, have fibers which are more flexible and can be refined at low concentrations and at small gaps without destroying the fibers. Moreover, the energy consumed in the refining operation is seldom higher than about 300 to 400 kWh/ton, which is about one-half to one-third of the energy consumed during the satisfactory refining of high-yield fibers in accordance with the present invention. It is also to be observed, that the fiber concentration of about 2 percent to about 5 percent of the low-yield types of fiber materials is the same both in the gap and in the refining housing, and that no special measures have been taken to reduce the friction loss between the outer surfaces of the refining discs and the fiber suspension in the refining housing. A fiber material, which after refining can be characterized as mechanical or chemimechanical pulp, is refined according to conventional techniques from raw material to finished pulp at a relatively high concentration in the range of about 20 percent to about 40 percent.

It will be understood that the embodiments described herein are merely exemplary and that a person skilled in the art may make many variations in and modifications without departing from the spirit and scope of the invention. All such modifications and variations are intended to be included within the scope of the invention as defined in the appended claims.

What is claimed is:

1. A method of refining lignocellulose-containing material in a disc refiner having a pair of refining discs, which define a gap therebetween, and a housing surrounding the discs, comprising the steps of feeding the material into the gap between the pair of discs; refining the material as it passes through the gap generally radially outwardly with respect to the pair of discs until it exits at an outlet of the gap at the periphery of the pair of discs; continuously flowing a liquid past the outlet of the gap so as to dilute the refined material to a fiber suspension of an easily pumpable concentration; and maintaining a predetermined amount of the fiber suspension adjacent to the outlet of the gap, whereby the pressure at said outlet of said gap may be controlled independently of the pressure in said housing and the retention time of the material in the gap between the pair of discs may be increased.

2. A method according to claim 1, wherein said material exiting from the outlet of the gap has a consistency in the range of from about 6 percent to about 15 percent.

3. A method according to claim 2, wherein the refined material is diluted to form a fiber suspension having a consistency in the range of from about 1 percent to about 6 percent.

4. A method according to claim 1, wherein the predetermined amount of fiber suspension is maintained at a predetermined pressure.

5. A method according to claim 4, wherein the pressure at which the predetermined amount of fiber suspension is maintained is adjustable.

6. A method according to claim 4, wherein the pressure at which the predetermined amount of fiber suspension is maintained is substantially equal to the pressure at which the material is maintained just prior to its entering the gap between the pair of discs.

7. A method according to claim 4, wherein the pressure at which the predetermined amount of fiber suspension is maintained is in the range of from about 10 kPa to about 260 kPa.

8. A method according to claim 4, wherein the pressure at which the predetermined amount of fiber suspension is maintained is in the range of from about 20 kPa to about 140 kPa.

9. A method according to claim 1, further comprising the step of diluting the material before it is fed into the gap between the pair of discs.

10. A method according to claim 9, wherein the consistency of the diluted but unrefined material is adjustable.

11. A method according to claim 1, wherein said predetermined amount of fiber suspension is maintained only in the vicinity of the outlet of the gap, whereby a major portion of the housing is void of fiber suspension.

* * * * *